US006629877B2

(12) United States Patent
Cerniway

(10) Patent No.: US 6,629,877 B2
(45) Date of Patent: Oct. 7, 2003

(54) PRECISION GLASS GRINDING

(76) Inventor: Leon A. Cerniway, 109 Wimbleton Sq., Chesapeake, VA (US) 23320

( * ) Notice: Subject to any disclaimer, the term of this patent is extended or adjusted under 35 U.S.C. 154(b) by 9 days.

(21) Appl. No.: 10/078,485

(22) Filed: Feb. 21, 2002

(65) Prior Publication Data

US 2002/0119736 A1 Aug. 29, 2002

Related U.S. Application Data

(60) Provisional application No. 60/270,102, filed on Feb. 21, 2001.

(51) Int. Cl.[7] ..... B24B 1/00

(52) U.S. Cl. ..... 451/43; 451/29; 451/342; 451/177; 451/412

(58) Field of Search ..... 451/44, 30, 31, 451/412, 6, 29, 177, 42, 342, 43

(56) References Cited

U.S. PATENT DOCUMENTS

| | | | | |
|---|---|---|---|---|
| 1,431,917 A | | 10/1922 | Antanaramian | |
| 3,194,153 A | * | 7/1965 | Roberson | 101/128.21 |
| 3,768,628 A | | 7/1972 | McMaster | |
| 3,708,936 A | | 1/1973 | Rogers | |
| 4,093,754 A | | 6/1978 | Parsons | |
| 4,538,383 A | | 9/1985 | Le Marer et al. | |
| 4,551,948 A | * | 11/1985 | Kindig et al. | 451/231 |
| 4,801,490 A | * | 1/1989 | Schuette | 428/211 |
| 4,955,162 A | | 9/1990 | Jackson | |
| 5,155,942 A | * | 10/1992 | Weber et al. | 451/6 |
| 5,307,594 A | * | 5/1994 | Panchison | 451/29 |
| 5,343,657 A | * | 9/1994 | Ohlin, Jr. | 451/29 |
| 5,628,677 A | | 5/1997 | Herrmann | |
| 5,681,211 A | * | 10/1997 | Wiand | 451/177 |
| 5,868,603 A | | 2/1999 | Allaire et al. | |
| 5,975,992 A | * | 11/1999 | Raeder et al. | 451/44 |
| 6,099,352 A | | 8/2000 | Yamaguchi | |
| 6,416,394 B1 | * | 7/2002 | Hacikyan et al. | 451/44 |

FOREIGN PATENT DOCUMENTS

| | | | | |
|---|---|---|---|---|
| EP | 484674 A | * | 5/1992 | 451/6 |

* cited by examiner

*Primary Examiner*—George Nguyen
(74) *Attorney, Agent, or Firm*—Merek, Blackmon & Voorhees, LLC

(57) ABSTRACT

Improved accuracy of grinding glass pieces for use in stained glass art and the like. The pattern of the final outer boundary of each piece of glass is traced onto frosted mylar tracing paper to create a mask. The mask is then cut to the traced pattern and is adhered to a piece of untrimmed glass of area greater than that of the mask, using water resistant adhesive. The outline of the pattern is rendered opaque, for example by an ink marker. Thus prepared, the untrimmed glass is abraded on a powered abrading machine having a flat, horizontal work table, a rotatable abrading element disposed to engage a workpiece supported on the work table, and lamps operating at low voltage arranged to back light the workpiece from therebelow. The untrimmed workpiece exhibits a brightly illuminated zone extending outside the opaque zone of the mask, thus emphasizing glass to be eroded. The workpiece is urged against the rotating abrading element until the illuminated zone is eliminated. Sharp visual contrast between the illuminated zone and the opaque zone of the mask assures that the glass piece will be trimmed accurately and precisely. The machine preferably has a second work table located above the first work table, a back lighting lamp located beneath the second work table, an eye shield and a lamp located beneath the eye shield, a transformer to reduce operating voltage to a low voltage, and a master switch controlling the motor of the rotatable abrading element and all lamps.

18 Claims, 3 Drawing Sheets

PRECISION GLASS GRINDING

REFERENCE TO RELATED APPLICATION

This application claims priority benefit of Provisional Patent Application Serial No. 60/270,102, filed Feb. 21, 2001, entitled GLASS GRINDING APPARATUS, which is incorporated herein by reference.

BACKGROUND OF THE INVENTION

1. Field of the Invention

The present invention relates to grinding of small pieces of sheet glass, for the purpose of shaping of the pieces to be fit into an assembly such as, for example, art works popularly known as stained glass.

2. Description of the Prior Art

Shaping of small pieces of glass to desired shapes, where these shapes include irregular wholly and partly curved peripheral boundaries, has conventionally been a laborious process requiring experience and skill on the part of the person shaping the glass. The process includes first inscribing a score corresponding to a desired outer peripheral boundary on a sheet of glass, then removing outlying unwanted glass to leave the remaining piece of glass in a desired final shape. The nature of glass renders removal of unwanted glass from the peripheral boundary difficult and tedious. A number of factors cause removal of unwanted glass to proceed in a manner which may be unintended and undesirable. For example, applying a bending moment along the score line may possibly not cause fracture to proceed along the score line. This may occur when surface irregularities and internal defects are present in the glass. Also, glass tends to fracture more or less in a straight line. These and other factors frequently cause the resulting peripheral boundary of a piece of glass being worked to depart from the original intended peripheral boundary.

In producing pieces of glass suitable for mounting using lead came and copper foil techniques, it is therefore desirable that the outer periphery of one piece of formed glass conform to a corresponding outer periphery of an adjacent section of glass. Moreover, it is desirable that the wall of a piece of formed glass be generally perpendicular to the flat major face of the glass. Therefore, despite taking steps such as forming curves in progressive steps of removal of glass and using grozing pliers to nibble away at peripheral boundaries, a piece of formed glass may take a form not suited to being placed in close proximity to an adjacent piece of glass.

The use of diamond grinding has advanced the art over purely manual methods but still is not fully reliable. Standard prior art practice is to start with a design drawn to full scale on paper. The design is transferred to heavier card stock paper. The card stock is cut along pattern lines using special three bladed scissors which remove a kerf while cutting the card stock into individual desired pattern pieces. The kerf accommodates lead came or copper foil which will separate adjacent pieces of cut glass, depending upon the method selected. The profile of each pattern piece is then inscribed upon stock glass. Typically, this is done by tracing each pattern piece in indelible ink marker. An alternative method is to adhere pattern pieces to glass using a water resistant rubber adhesive. Both methods of inscribing the pattern on the glass entail drawbacks.

One problem common to both approaches is that the three bladed scissors have severe difficulty in cutting curves. Also, when pattern pieces are cut from the master card, extreme care must be exercised to assure that the pieces be cut to reflect their actual location and spacing relative to the master design. This step is frequently not accomplished, with the consequence that the design increases in scale as cutting proceeds. Transference using indelible ink marking has the problem that if grinding is made to the edge of the ink line, the resultant piece will be slightly larger than desired. Adjacent finished glass pieces must then be spaced farther from their ideal locations, or else the gap separating adjacent glass pieces is too small. If grinding erodes the entire ink line, then the ground part will be too small and will fit poorly into the design. The ink line is also subject to being expunged from the glass by action of the glass shavings slurry produced during grinding. The approach of using a paper template adhered to the glass also suffers from the problem that edges of the paper card stock soften when moistened, and become subject to distortion by the operator's fingers as grinding proceeds. Finally, it is frequently difficult to discern precise location of the grinding surface relative to the pattern marking because the grinding wheel is coated with the glass shavings slurry.

Problems inherent in traditional methods of glass shaping include breakage and redundant attempts to form difficult shapes, loss of time, breakage, and necessity for skilled craftsmanship. There exists in the prior art a need for improved shaping of glass pieces.

SUMMARY OF THE INVENTION

The present invention sets forth improvements which enable those of more ordinary skill to grind desired shapes into glass pieces with greater precision and reduced reliance upon breaking away sections using scores. Additionally, the problems relating to conventional diamond grinding are substantially overcome. The invention utilizes a water resistant translucent or transparent mask material bearing an opaque outer periphery to locate the edge of the desired pattern on the glass. Transparency of the mask enables the pattern to be traced directly onto the mask, rather than using the cumbersome prior art practice of interposing carbon paper between the master pattern and the card stock material used as a mask. The novel mask is cut by conventional two bladed scissors, which can cut along curves, rather than using the traditional three bladed scissors which form a kerf. The novel mask, being water resistant, is not distorted by handling in a wet environment.

The periphery of the design on the mask is darkened or otherwise made to contrast visually with untreated portions of the glass, so that the desired pattern is immediately and readily discerned. This treatment of the glass work piece becomes more effective when taken in conjunction with a modification to the diamond grinding apparatus wherein backlighting is introduced thereto. In this modification, the diamond grinding machine is provided with lamps arranged to provide backlighting which will bring the darkened or preferably opaque outer periphery of the pattern into clear view despite fouling from the glass shavings slurry. Bearing in mind that most glass pieces being ground are usually colored, it will be appreciated that prior to grinding, a strongly colored, strongly illuminated zone of excess glass to be removed exists between the grinding surface and the opaque outer periphery of the mask. The operator of the diamond grinder is thus afforded clearly discernible indication of material still to be removed.

It is an object of the invention to provide improved elements and arrangements thereof in an apparatus for the purposes described which is inexpensive, dependable and fully effective in accomplishing its intended purposes. This and other objects of the present invention will become readily apparent upon further review of the following specification and drawings.

BRIEF DESCRIPTION OF THE DRAWINGS

Various other objects, features, and attendant advantages of the present invention will become more fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

Figure 1:
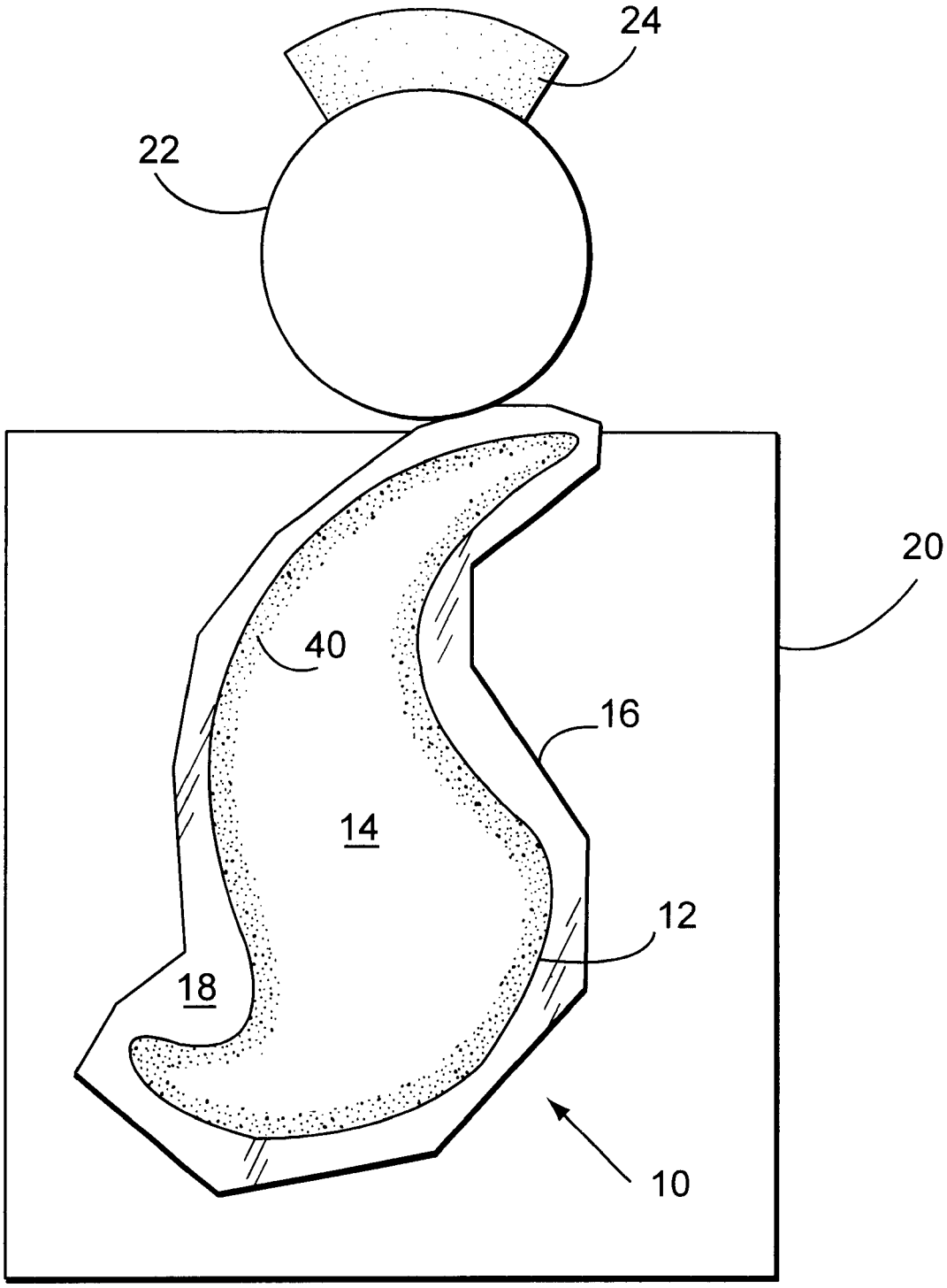
FIG. 1 is a partial diagrammatic view of a section of glass about to be ground according to the invention.

FIG. 1 of the drawings shows a section 10 of glass sheet which is to be ground to have a predetermined curved or non-linear periphery corresponding to a design pattern 12. Pattern 12 is shown as a line forming a closed loop, generally simulating the letter "S".

A mask 14 cut to the profile of pattern 12 is adhered to section 10 of glass. Mask 14 enables a person (not shown) to grind section 10, using a wet abrasive grinding process, to modify section 10 to have the precise profile of pattern 12. The resultant modified section of glass provides one piece of a mosaic or set of many sections of cut glass (none shown) which are to be assembled to form a stained glass window or other artistic assemblage starting from individual uniquely profiled sections of glass.

Section 10 and its associated mask 14 are initially prepared as follows. A full scale drawing or cartoon of the final assemblage is rendered on paper. A generally light permeable material such as dimensionally stable frosted drafting polymeric material including that known as mylar is placed over the cartoon. Light permeable signifies that the material is transparent or is sufficiently translucent to enable tracing and grinding according to the method set forth hereinafter. An individual section corresponding to the profile of one piece of the assemblage is traced onto the mylar. Mask 14 is formed by cutting along the traced line with ordinary two bladed scissors (not shown) to trim the sheet of mask material to remove all portions thereof which extend outside the design pattern, thereby producing a trimmed mask. The scissors may be any general purpose or commercially available scissors having cutting characteristics sufficiently precise to cut mask 14 to conform to pattern 12. Mask 14 is adhered onto section 10. Section 10 has preferably been shaped to the point of approaching the final intended profile of pattern 12 as indicated by silhouette line 16 by scoring and breaking, or in any suitable way.

Because final shaping is accomplished employing a wet abrasive process, which utilizes a cutting liquid such as water for cooling, lubricating, suppressing dust, or any combination of these, the adhesive is preferably one soluble in an organic solvent such as a commercial paint thinner, acetone, or other substance, and is impervious to water or to the liquid used as a cutting liquid, if the cutting liquid is other than water. Section 10 of glass sheet is then abraded to remove all glass material therefrom except that glass material disposed in overlying relation to the mask. The glass material to be removed is seen in FIG. 1 as a peripheral zone 18 surrounding pattern line 12.

Section 10 of glass is now ready to be abraded, and is shown from above, lying on a flat work table 20 of a wet abrading machine 26 (see FIG. 3), abutting the rotatable abrading element 22. Work table 20 is preferably a perforated member comprising, for example, an open mesh material. A sponge 24 draws water (not shown) from a reservoir by capillary action, and dispenses the water to abrading element 22. Other components of the abrading machine are deleted from FIG. 1 for clarity of the view.

Figure 3:
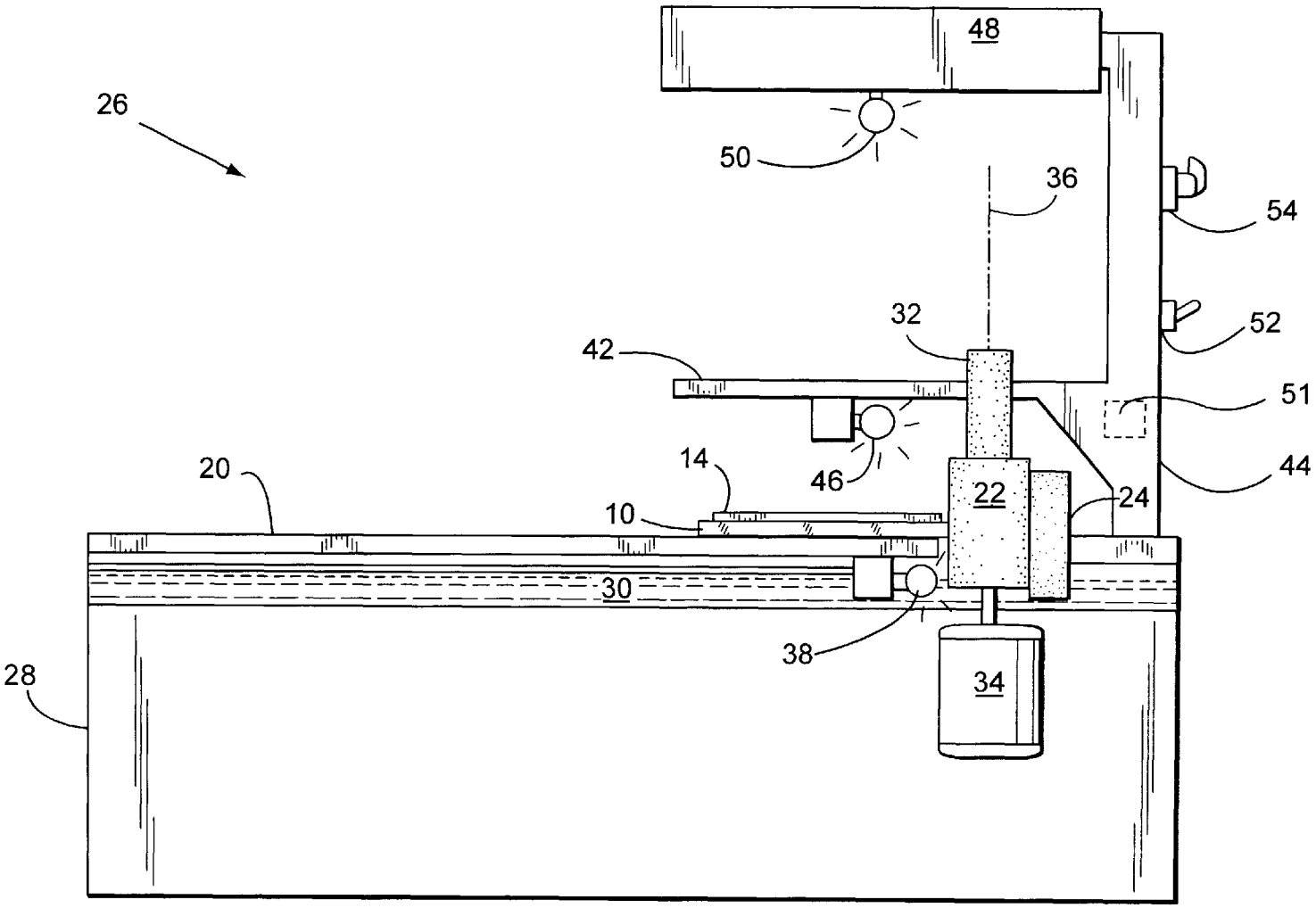
FIG. 3 is a diagrammatic side elevational view of a grinding apparatus which provides lighting according to the invention.

Turning now to FIG. 3, significant details of abrading machine 26 are shown. Machine 26 includes a housing 28 forming a receptacle for storing water 30. Water 30 is drawn by sponge 24 to abrading element 22. The receptacle and sponge 24 collectively provide a supply circuit arranged to dispense cutting liquid to abrading element 22. A second abrading element 32 connected to and driven in common with abrading element 22 by a motor 34 is seen in FIG. 3. It will be seen that the rotational axis 36 of motor 34 and abrading elements 22, 32 is arranged vertically in normal use. Water 30 is covered by first work table 20. Section 10 of glass is horizontally slidably supported on work table 20. A user places his or her fingers on section 10 of glass and slidingly urges section 10 of glass against abrading element 22 when motor 34 is operating. Work table 20 is located sufficiently adjacent to abrading element 22 to support section 10 of glass as the user urges section 10 against abrading element 22.

An important feature of machine 26 is provision of at least one lamp 38 arranged to project visible light against the work piece, which is in the present example section 10 of glass, in an area proximate abrading element 22. Lamp 38 is located on that side of the work piece opposite that facing the user. In the embodiment of FIG. 3, lamp 38 is located beneath work table 20. It will be appreciated that the hands and face of the user will be above work table 20 when machine 10 is in the normal orientation shown in FIG. 3 with the workpiece placed on the upper surface of work table 20, and when the user is grinding glass.

Significance of lamp 38 is that when it is illuminated, section 10 of glass is illuminated to the point that zone 18 (see FIG. 1) visually contrasts strongly with the opaque outer periphery or zone 40 of mask 14. Zone 40 is rendered opaque by any suitable agent prior to grinding. One way is to apply ink of an indelible marker (not shown). Another way is to adhere an opaque, liquid impervious film. Although the entire pattern can be rendered opaque or covered, it is only critical that the periphery be so treated, for guiding and limiting abrading. Returning now to FIG. 1, zone 18 of section 10 of class is clearly discerned. It will be appreciated that given the distracting, fouled environment of machine 26 when operating, illumination and enhanced visibility of zone 18 will clearly assist the user when grinding.

Figure 2:
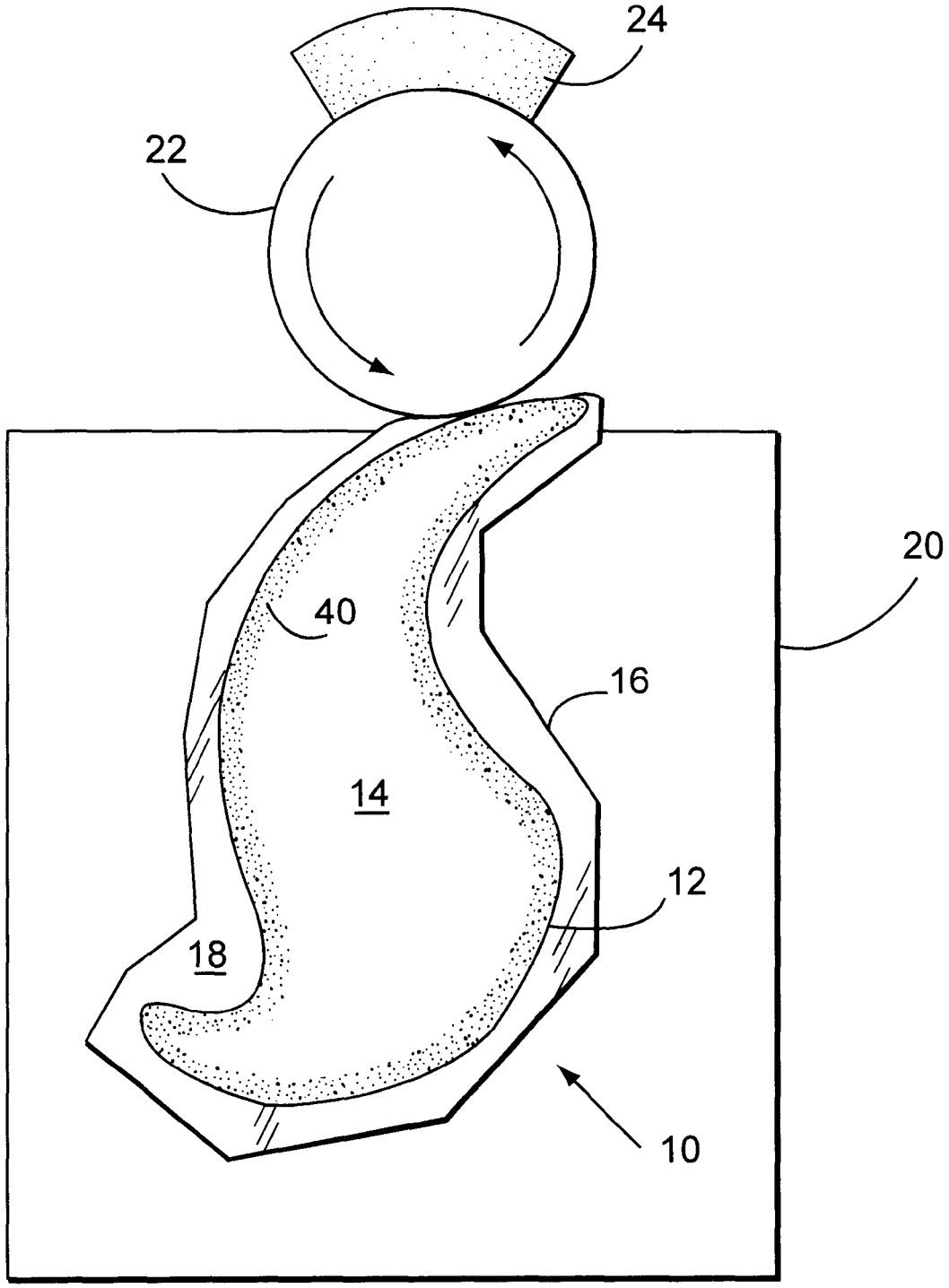
FIG. 2 is similar to FIG. 1, but shows a condition which exists after grinding has started.

Grinding is performed simultaneously with back lighting of section 10 by lamp 38. Section 10 of glass is urged against rotating abrading element 22 until zone 18 is eroded. Alternatively stated, all glass material is abraded from section 20 except that glass material which underlies mask 14. While grinding, the user observes zone 18, which is illuminated by lamp 38 to the extent that it will appear to glow of its own accord. Turning now to FIG. 2, a localized portion of zone 18 has been eroded from section 10 of glass. Mask 14 now directly contacts abrading element 22. The user terminates abrading section 10 of glass at this localized area, and maneuvers section 10 to complete removal of zone 18 of glass around the entire periphery of section 10. Grinding is terminated when zone 18 is fully removed. The user is careful to avoid abrading section 10 at every portion thereof which underlies mask 14. These steps afford remarkably precise and accurate grinding of glass pieces even by those not of advanced skills.

Returning to FIG. 3, the preferred embodiment of machine 26 includes the following additional features. A second work table 42 is supported on a standard 44 fixed to housing 28. Standard 44 supports work table 42 above work table 20. Work table 42 is provided with a back lighting lamp 46 which is functionally similar to lamp 38. Work table 42 is located sufficiently adjacent to second abrading element 32 to enable grinding to be performed in a manner generally similar to that of abrading element 22. However abrading element 32 has at least one grinding characteristic different from that of abrading element 22. As shown, abrading element 32 has a smaller diameter than does abrading element 22, thereby being able to impart curvature of smaller radius when grinding. Of course, grit fineness and other characteristics could be provided instead of or in addition to dimensional differences.

An eye shield 48 is disposed above both work tables 20, 42, and is supported on standard 44. A lamp 50 disposed below eye shield 48 is arranged to project light downwardly onto work tables 20, 42.

Electrically operated lamps 38, 46, 50 and optionally, motor 34, are powered by circuitry (not shown) including a low voltage power supply for operating at a low voltage. Low voltage will be understood to be voltages below normal commercially available household or commercial voltages of general purpose single phase circuits in buildings, which are typically 120 volts, 208 volts, and 240 volts. Preferably, the low voltage will be at a level regarded by municipal authorities and private authorities such as Underwriters Laboratories as being inherently safe. The low voltage power supply may comprise battery cells or in the preferred embodiment, a transformer 50. The circuitry will be understood to include all necessary conductors, connectors, protective devices and switches, whether or not shown, required to afford operability.

Preferably, switches include a master switch 52 which simultaneously controls all lamps 38, 46, and 50 as well as motor 34. In addition to master switch 52 there is provided a selector switch 54 disposed to selectively operate any one of lamps 38, 46, or 50 to the exclusion of the others. Of course, any combination of lamps 38, 46, and 50 can be accommodated to suit.

The present invention is susceptible to variations and modifications which may be introduced thereto without departing from the inventive concept. For example, abrading element 22, which has been described as rotatable and diamond surfaced, may be modified to provide the same function while assuming other forms. Notably, the element may bear any material capable of abrading glass. Also, the abrading element may be arranged to oscillate or to move in any other manner enabling grinding of glass. Alternatively, the supporting surface bearing the glass may be mobile, with the abrading element remaining fixed.

In another example, mask material may comprise opaque ink applied directly to the glass, thereby eliminating mylar and other intermediate materials.

It is to be understood that the present invention is not limited to the embodiments described above, but encompasses any and all embodiments within the scope of the following claims.

I claim:

1. A method of grinding a predetermined non-linear periphery corresponding to a design pattern into a section of glass sheet using an abrasive grinding process, comprising the steps of:

providing at least one section of glass sheet;

providing a light permeable sheet of mask material;

tracing the design pattern on the sheet of mask material;

trimming the sheet of mask material to remove portions thereof which extend outside the design pattern, thereby producing a trimmed mask;

adhering the trimmed mask onto the section of glass sheet; and abrading the glass sheet to remove glass material therefrom except that glass material disposed in overlying relation to the mask.

2. The method according to claim 1, wherein said abrasive grinding process is a wet grinding process having a cutting liquid dispensed onto a moving abrading element, and wherein said step of adhering the trimmed mask comprises the further step of employing adhesive which is resistant to the cutting liquid to adhere the trimmed mask to the section of glass sheet.

3. The method according to claim 1, wherein said step of trimming the sheet of mask material to remove all portions thereof which extend outside the design pattern comprises the further step of cutting the sheet of mask material with two bladed scissors.

4. The method according to claim 1, wherein said step of providing a light permeable sheet of mask material comprises the further step of providing frosted mylar drafting film.

5. The method according to claim 1, comprising the further step of back lighting the glass sheet simultaneously with practicing said step of abrading the glass sheet to remove all glass material therefrom except that glass material which underlies the mask.

6. The method according to claim 1, comprising the further steps of:

observing a zone of illuminated glass sheet extending outside the mask while practicing said step of abrading the glass sheet; and terminating abrading the glass sheet when the zone of illuminated glass sheet extending outside the mask is fully removed by abrasion.

7. The method according to claim 6, comprising the further step of avoiding abrading the glass sheet at every portion thereof which underlies the mask.

8. A method of grinding a predetermined curved periphery corresponding to a design pattern into a section of glass sheet using a wet abrasive grinding process wherein a cutting liquid is dispensed onto a moving abrading element, comprising the steps of:

providing at least one section of glass sheet;

masking the glass sheet at the predetermined curved periphery corresponding to the design pattern;

back lighting the glass sheet to reveal an unmasked peripheral zone of the glass sheet surrounding the design pattern line; and abrading the glass sheet to remove all glass material from the unmasked peripheral zone thereof, and leaving that glass material disposed in overlying relation to the mask.

9. The method according to claim 8, comprising the further steps of:

observing the unmasked peripheral zone of illuminated glass sheet extending outside the mask while practicing said step of abrading the glass sheet; and terminating abrading the glass sheet when the unmasked peripheral zone of illuminated glass sheet extending outside the mask is fully removed by abrasion.

10. The method according to claim 8, comprising the further step of avoiding abrading the glass sheet at every portion thereof which underlies the mask.

11. Abrading apparatus for enabling a user to grind peripheral edges of flat work pieces, comprising:

a flat first work table for supporting a work piece horizontally;

a rotatable abrading element having a generally vertical axis of rotation, disposed adjacent said first work table such that a work piece can be urged laterally against said abrading element while being supported on said first work table, and a motor drivingly connected thereto;

a cutting fluid system including a supply circuit arranged to dispense cutting liquid to said abrading element; and at least one first lamp arranged to project visible light against the work piece in an area proximate said abrading element, wherein said lamp is located on a side of the work piece opposite that facing the user.

12. The abrading apparatus according to claim 11, wherein said first lamp is located beneath said first work table when said first work table is oriented horizontally and a work piece is placed on the upper surface of said first work table.

13. The abrading apparatus according to claim 11, further comprising a low voltage power supply for operating said first lamp at a low voltage.

14. The abrading apparatus according to claim 11, further comprising:

a second work table and supporting structure for supporting said second work table above said first work table;

a rotatable second abrading element having a generally vertical axis of rotation, disposed adjacent said second work table such that a work piece can be urged laterally against said second abrading element while being supported on said second work table, wherein said second abrading element has at least one grinding characteristic different from that of said first abrading element; and at least one second lamp arranged to project visible light against the work piece in an area proximate said second abrading element, wherein said second lamp is located on a side of the work piece opposite that facing the user.

15. The abrading apparatus according to claim 11, further comprising an eye shield disposed above said first work table, and at least one third lamp disposed below said eye shield, wherein said third lamp is arranged to project light downwardly onto said first work table.

16. The abrading apparatus according to claim 11, further including a transformer disposed to transform voltage electrical power from a household voltage to a low voltage, wherein said transformer is connected to said first lamp.

17. The abrading apparatus according to claim 11 further comprising a master switch disposed to control electrical power to said first lamp and to said motor drivingly connected to said abrading element.

18. The abrading apparatus according to claim 11, further comprising:

a second work table and supporting structure for supporting said second work table above said first work table;

a rotatable second abrading element having a generally vertical axis of rotation, disposed adjacent said second work table such that a work piece can be urged laterally against said second abrading element while being supported on said second work table, wherein said second abrading element has at least one grinding characteristic different from that of said first abrading element;

at least one second lamp arranged to project visible light against the work piece in an area proximate said second abrading element, wherein said second lamp is located on a side of the work piece opposite that facing the user;

an eye shield disposed above said first work table, and at least one third lamp disposed below said eye shield, wherein said third lamp is arranged to project light downwardly onto said first work table;

a transformer disposed to transform voltage electrical power from a household voltage to a low voltage, wherein said transformer is connected to said first lamp, said second lamp, and said third lamp; and a master switch disposed to control electrical power to said first lamp, said second lamp, said third lamp, and said motor drivingly connected to said abrading element.

* * * * *